US009509063B2

(12) United States Patent
Rousu et al.

(10) Patent No.: US 9,509,063 B2
(45) Date of Patent: Nov. 29, 2016

(54) WIRELESS COMMUNICATION ARRANGEMENT

(71) Applicant: Broadcom Corporation, Irvine, CA (US)

(72) Inventors: Seppo Rousu, Oulu (FI); Yrjo Kaipainen, Espoo (FI); Kim Kaltiokallio, Helsinki (FI); Marko Tapio Autti, Oulu (FI)

(73) Assignee: Broadcom Corporation, Irvine, CA (US)

( * ) Notice: Subject to any disclaimer, the term of this patent is extended or adjusted under 35 U.S.C. 154(b) by 321 days.

(21) Appl. No.: 14/064,532

(22) Filed: Oct. 28, 2013

(65) Prior Publication Data

US 2014/0118200 A1 May 1, 2014

(30) Foreign Application Priority Data

Oct. 30, 2012 (GB) ..... 1219524.4

(51) Int. Cl.
*H01Q 21/28* (2006.01)
*H01Q 1/32* (2006.01)

(52) U.S. Cl.
CPC ..... *H01Q 21/28* (2013.01); *H01Q 1/3275* (2013.01); *Y10T 29/49018* (2015.01)

(58) Field of Classification Search
CPC ..... H01Q 1/3275; H01Q 23/00; H01Q 21/28
See application file for complete search history.

(56) References Cited

U.S. PATENT DOCUMENTS

| | | | | |
|---|---|---|---|---|
| 6,448,930 | B1 | 9/2002 | Judd | |
| 7,265,719 | B1 * | 9/2007 | Moosbrugger .... | H01Q 21/0025 343/700 MS |
| 2002/0175879 | A1 | 11/2002 | Sabet et al. | |
| 2010/0099370 | A1 | 4/2010 | Nichols et al. | |

* cited by examiner

*Primary Examiner* — Robert Karacsony
(74) *Attorney, Agent, or Firm* — Oblon, McClelland, Maier & Neustadt, L.L.P.

(57) ABSTRACT

A wireless communication arrangement (100*a*) with multiple antennas for a vehicle includes a first printed circuit board (110) having a modem unit (111) and a radiating antenna element (113); a second printed circuit board (120) having a radiating antenna element (123); an interface unit (112) disposed on the first printed circuit board (110) and/or the second printed circuit board (120); and a main bendable portion (130) bendably and electrically connecting the first printed circuit board (110) and the second primed circuit board (120) to each other. The first printed circuit board (110) and the second printed circuit board (120) are mountable on an outer surface of a vehicle in non-horizontal orientation with respect to said outer surface, with the first printed circuit board (110) and the second printed circuit board (120) forming a convex like shape in a horizontal direction via bending of the main bendable portion (130).

20 Claims, 3 Drawing Sheets

WIRELESS COMMUNICATION ARRANGEMENT

TECHNICAL FIELD

The invention relates generally to wireless communications. In particular, but not exclusively, the invention relates to a wireless communication apparatus for a vehicle.

DESCRIPTION OF THE RELATED ART

Wireless communication devices for installation on a vehicle roof are known. However, typically these are distributed so that an antenna is disposed on the vehicle roof and a radio frequency front end and other active elements are disposed at a distance from the antenna, e.g. somewhere inside the vehicle. This requires radio frequency cables between the antenna and the rest of the elements. Such cables are sensitive to interference and add to overall cost.

Wireless communication devices for installation on a vehicle roof, in which the antenna and at least some of the active elements are arranged at a single unit, are also known. However, such devices typically only have one printed circuit board on which all the elements are disposed. In the case of multiple antennas, this severely limits the way the antennas cart be positioned with regards to each other, thereby deteriorating chances to optimize various quality parameters of the wireless communication.

SUMMARY

Embodiments of the present invention provide a wireless communication arrangement with multiple antennas for a vehicle, in which the antennas can be positioned a suitable distance from each other to enable good efficiency and radiation patterns and low envelope correlation.

A first aspect of the present invention is a wireless communication apparatus for a vehicle. The wireless communication apparatus comprises a first rigid printed circuit board having a modem unit disposed on it, and having at least one radiating antenna element at least partly embedded in it. The wireless communication apparatus further comprises a second rigid printed circuit board having at least one radiating antenna element at least partly embedded in it. The wireless communication apparatus further comprises at least one interface unit disposed on at least one of the first rigid printed circuit board and the second rigid printed circuit board. The wireless communication apparatus further comprises a main bendable portion bendably and electrically connecting the first rigid printed circuit board and the second rigid printed circuit board to each other. The first rigid printed circuit board and the second rigid printed circuit board are mountable on an outer surface of a vehicle in non-horizontal positions with respect to a mounting area of the outer surface, with the first rigid printed circuit board and the second rigid printed circuit board forming a convex like shape in a horizontal direction via bending of the main bendable portion.

A second aspect of the present invention is a vehicle comprising the wireless communication apparatus of the first aspect mounted on its outer surface forming the convex like shape in the horizontal direction.

A third aspect of the present invention is a method of providing a wireless communication apparatus for a vehicle, comprising:

providing a first rigid printed circuit board having a modem unit disposed on it, and having at least one radiating antenna element at least partly embedded in it;

providing a second rigid printed circuit board having at least one radiating antenna element at least partly embedded in it;

disposing at least one interface unit on at least one of the first rigid printed circuit board and the second rigid printed circuit board; and providing a main bendable portion bendably and electrically connecting the first rigid printed circuit board and the second rigid printed circuit board to each other;

wherein the first rigid printed circuit board and the second rigid printed circuit board are mountable on an outer surface of a vehicle in non-horizontal positions with respect to a mounting area of the outer surface, with the first rigid printed circuit board and the second rigid printed circuit board forming a convex like shape in a horizontal direction via bending of the main bendable portion.

In an embodiment of the invention, the non-horizontal positions are substantially vertical positions.

In an embodiment of the invention, at least one of the first rigid printed circuit board and the second rigid printed circuit board further has at least one additional modem unit disposed on it.

In an embodiment of the invention, at least one radiating antenna element in the first rigid printed circuit board and at least one radiating antenna element in the second rigid printed circuit board are positioned in their respective printed circuit boards such that they are located substantially opposite each other in the convex like shape.

In an embodiment of the invention, at least one of the first rigid printed circuit board and the second rigid printed circuit board comprises at least one additional bendable portion, the at least one additional bendable portion bendable at least one of inwards and outwards with respect to the convex like shape.

In an embodiment of the invention, at least one additional bendable portion is located at the end portion of its respective rigid printed circuit board which is opposite to the end to which the main bendable portion is connected.

In an embodiment of the invention, at least one of the radiating antenna elements in at least one of the first rigid printed circuit board and the second rigid printed circuit board is at least partly embedded in one of the additional bendable portions of the respective rigid printed circuit board.

In an embodiment of the invention, a vehicle light element is arranged between the first rigid printed circuit board (110) and the second rigid printed circuit board (120) at an open end of the convex like shape.

In an embodiment of the invention, a bending radius of the convex like shape is utilized to optimize predetermined quality parameters of the wireless communication apparatus.

In an embodiment of the invention, the predetermined quality parameters comprise at least one of efficiency, radiation patterns, and envelope correlation.

In an embodiment of the invention, the modem unit and the additional modem unit share at least two of the radiating antenna elements for at least one of MIMO (multiple-input and multiple-output) and diversity operation for at least one of data and voice using e.g. one or more subscriber identity modules.

In an embodiment of the invention, the convex like shape is one of a substantially V-like shape and a substantially U-like shape.

It is to be understood that the aspects and embodiments of the invention described above may be used in any combination with each other. Several of the aspects and embodiments may be combined together to form a further embodiment of the invention. An apparatus, a method, or a vehicle which is an aspect of the invention may comprise at least one of the embodiments of the invention described above.

The invention allows a wireless communication arrangement with multiple antennas for a vehicle in which the antennas can be positioned in a suitable distance from each other to enable good efficiency and radiation patterns and low envelope correlation. The invention further allows different antenna polarizations, increased antenna isolations, different radiation patterns between radiating antenna elements, and improved de-correlation.

BRIEF DESCRIPTION OF THE DRAWINGS

The accompanying drawings, which are included to provide a further understanding of the invention, illustrate exemplary embodiments of the invention and, together with the description, help to explain the principles of the invention. In the drawings.

DETAILED DESCRIPTION

Reference will now be made in detail to the embodiments of the invention, examples of which are illustrated in the accompanying drawings.

Figure 1A:
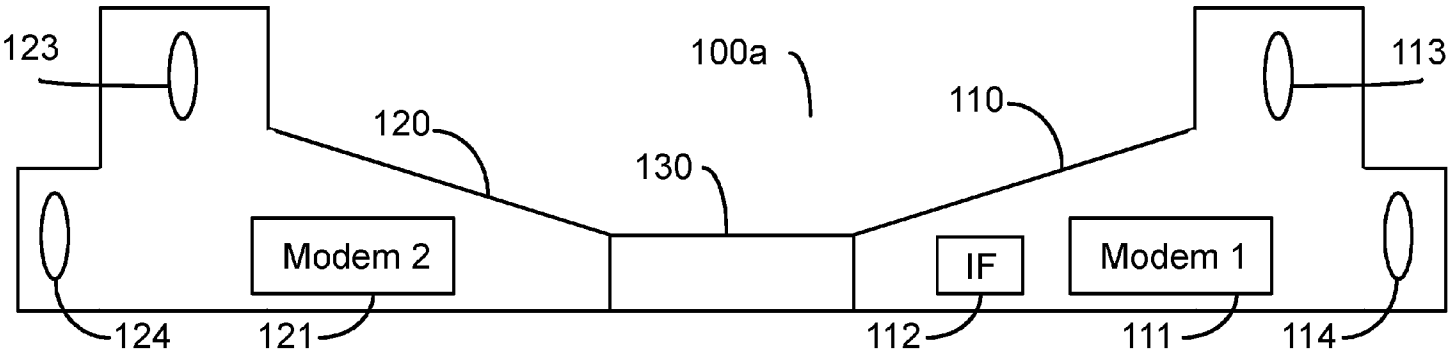
FIG. 1*a* is a schematic diagram showing an assembly view of an embodiment of the invention.
Figure 1B:
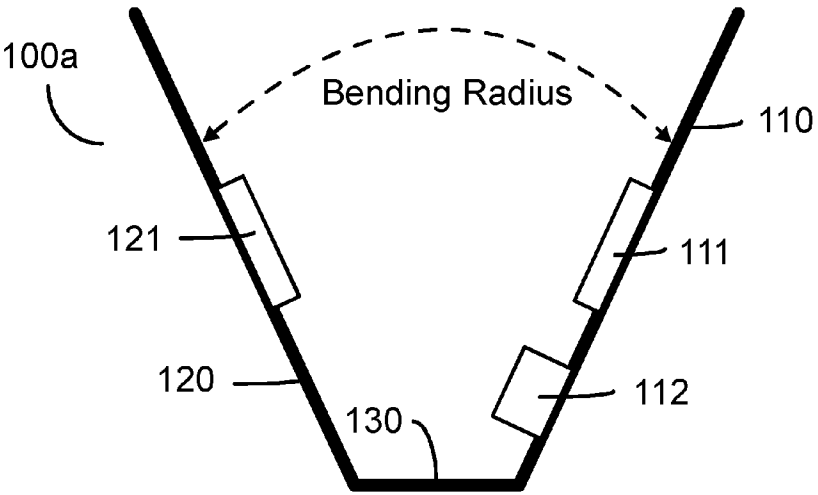
FIG. 1*b* is a schematic diagram showing a top view of the embodiment of FIG. 1*a;*

FIG. 1*a* is an assembly view of an embodiment of the invention, and FIG. 1*b* is a top view of the embodiment of FIG. 1*a*.

FIGS. 1*a* and 1*b* show a wireless communication apparatus 100*a* for a vehicle. The wireless communication apparatus 100*a* comprises a first rigid printed circuit board 110 having a modem unit 111 disposed on it and radiating antenna elements 113, 114 embedded in it. It is to be noted that even though two radiating antenna elements 113, 114 are shown in FIG. 1*a*, there may be only one radiating antenna element in the first rigid printed circuit board 110 or there may be more than two radiating antenna elements in the first rigid printed circuit board 110. The wireless communication apparatus 100*a* further comprises a second rigid printed circuit board 120 having radiating antenna elements 123, 124 embedded in it. Again, it is to be noted that even though two radiating antenna elements 123, 124 are shown in FIGS. 1*a* and 1*b*, there may be only one radiating antenna element in the second rigid printed circuit board 120 or there may be more than two radiating antenna elements in the second rigid printed circuit board 120. Furthermore, as shown in the embodiment of FIGS. 1*a* and 1*b*, the second rigid printed circuit board (or the first rigid printed circuit board 110 even though this is not shown in FIGS. 1*a* and 1*b*) may also have at least one additional modem unit 121 disposed on it.

Furthermore, even though FIG. 1*a* shows the radiating antenna elements 113, 114, 123, 124 embedded completely in their respective rigid printed circuit boards 110 and 120, at least one of the radiating antenna elements 113, 114, 123, 124 may instead be positioned so that it is embedded partly in the first rigid printed circuit board 110 and/or in the second rigid printed circuit board 120, and partly in a main bendable portion 130 (described in more detail below).

At least one of the radiating antenna elements 113-114 and 123-124 may be e.g. one of: a cellular antenna, a Wi-Fi antenna, a global positioning system (e.g. GPS, Glonass, Galileo, Beidou, sbas) antenna, or the like. At least one of the radiating antenna elements 113-114 and 123-124 may be made as off-ground antennas with removal of copper layers from antenna area. At least one of the radiating antenna elements 113-114 and 123-124 may be implemented during printed circuit board manufacturing process. Because radiating antenna elements and electrical components are at a same printed circuit board, separate radio frequency cables and connectors are avoided, gain and reliability are improved, and additional insertion loss caused by these is avoided.

The wireless communication apparatus 100*a* further comprises an interface unit 112 that is disposed on the first rigid printed circuit board 110. It is to be noted that in another embodiment the interface unit 112 could be disposed on the second rigid printed circuit board 120 (not shown). In yet another embodiment, two or more interface units 112 could be disposed—one or more on the first rigid printed circuit board 110 and one or more on the second rigid printed circuit board 120 (not shown). The interface unit 112 may comprise e.g. a universal serial bus (USB) interface.

Either or both faces of the first rigid printed circuit board 110 and the second rigid printed circuit board 120 may be utilized in disposing the modem units 111, 121 and the interface unit(s) 112.

The wireless communication apparatus 100*a* flintier comprises a main bendable portion 130 that is bendably and electrically connecting the first rigid printed circuit board 110 and the second rigid printed circuit board 120 to each other. It is to be noted that herein the term "bendable" includes "flexible". That is, the main bendable portion 130 may be a portion bendable at its joint ends with the first rigid printed circuit board 110 and the second rigid printed circuit board 120, as shown in FIGS. 1*a*-1*e*. However, in an embodiment, the main bendable portion 130 may be of flexible material that is bendable throughout its length. Furthermore, even though the main bendable portion 130 shown in FIGS. 1*a*-1*e* is rectangular in shape, the main bendable portion 130 may have any suitable shape, e.g. a trapezoid.

The first rigid printed circuit board 110 and the second rigid printed circuit board 120 are mountable on an outer surface of a vehicle in non-horizontal positions (in other words, each printed circuit board, which comprises a generally planar structure, is arranged in a non-horizontal orientation/plane) with respect to a mounting area of the outer surface, with the first rigid printed circuit board 110 and the second rigid printed circuit board 120 forming a convex like shape in a horizontal direction via bending of the main bendable portion 130. This is illustrated in FIG. 1*b* in which the first rigid printed circuit board 110, the second rigid printed circuit board 120 and the main bendable portion 130 together form a convex like shape when viewed from above.

The convex like shape may be e.g. one of a substantially V-like shape and a substantially U-like shape, when viewed from above. In an embodiment, the convex like shape may be e.g. a boomerang like shape when viewed from above.

As described above, the first rigid printed circuit board 110 and the second rigid printed circuit board 120 are mountable on the outer surface of the vehicle in non-horizontal positions with respect to the mounting area of the outer surface. In an embodiment, "non-horizontal" is substantially vertical (in other words, is substantially upright in orientation, in a vertical plane). In an embodiment, at least one of the first rigid printed circuit board 110 and the second rigid printed circuit board 120 may be tilted inwards or outwards (with respect to an upright orientation) as needed. For example, in some implementations an inward tilt may help to reduce the overall volume taken by the wireless communication apparatus 100*a*.

In an embodiment of the invention, at least one radiating antenna element in the first rigid printed circuit board and at least one radiating antenna element in the second rigid printed circuit board are positioned in their respective printed circuit boards such that they are located or positioned substantially opposite each other in the convex like shape. For example, in the embodiment of FIG. 1*a*, radiating antenna elements 113 and 123 will be located substantially opposite each other when the wireless communication apparatus 100*a* is bent into the convex like shape of FIG. 1*b*. Similarly, in the embodiment of FIG. 1*a*, radiating antenna elements 114 and 124 will be located substantially opposite 110 each other when the wireless communication apparatus 100*a* is bent into the convex like shape of FIG. 1*b*.

A bending radius of the convex like shape shown in FIG. 1*b* may be utilized to optimize predetermined quality parameters of the wireless communication apparatus 100*a*. These predetermined quality parameters may comprise e.g. at least one of efficiency, radiation patterns, and envelope correlation. Also, maintenance of quality of power signals, radio frequency signals, control signals etc. over the main bendable portion 130 may also be considered when selecting the bending radius.

The modem unit 111 and the additional modem unit 121 may share at least two of the radiating antenna elements 113-114 and 123-124 for at least one of MIMO (multiple-input and multiple-output) and diversity operation. In an embodiment, shared antenna elements may be located substantially opposite each other. In another embodiment, shared antenna elements may be designed to not be located substantially opposite to each other. Furthermore, antennas for each modem's operational antenna configuration may be altered for radio communication. This may be done for example to select an antenna having better directivity to a direction where signals from communication counterpart(s) are coming. The communication counterpart may be e.g. one or more cell towers or alternate UEs (user equipment).

The bent convex like shape of the wireless communication apparatus 100*a* of the invention allows different antenna polarizations, increased antenna isolation, different radiation patterns between radiating antenna elements, and improved de-correlation. The antennas can be positioned a suitable distance from each other to enable good efficiency and radiation patterns and low envelope correlation. For example, for MIMO/diversity operations correlations may be below 0.5. Antenna isolation may be over ~10 . . . ~12 dB, such as substantially 20 dB.

Figure 1C:
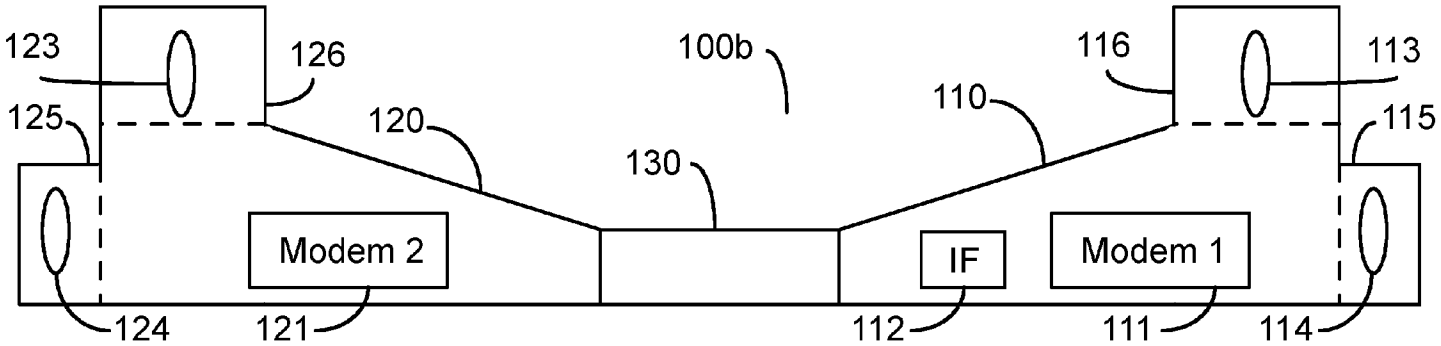
FIG. 1*c* is a schematic diagram showing an assembly view of another embodiment of the invention.
Figure 1E:
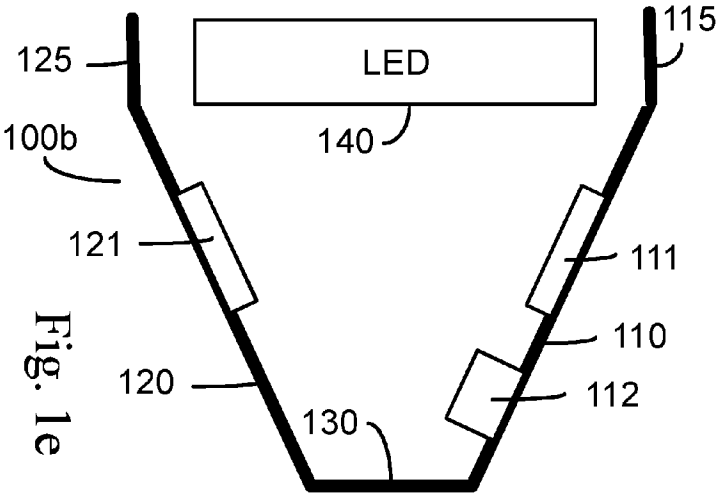
FIG. 1*e* is a schematic diagram showing a top view of yet another embodiment of the invention.
Figure 1D:
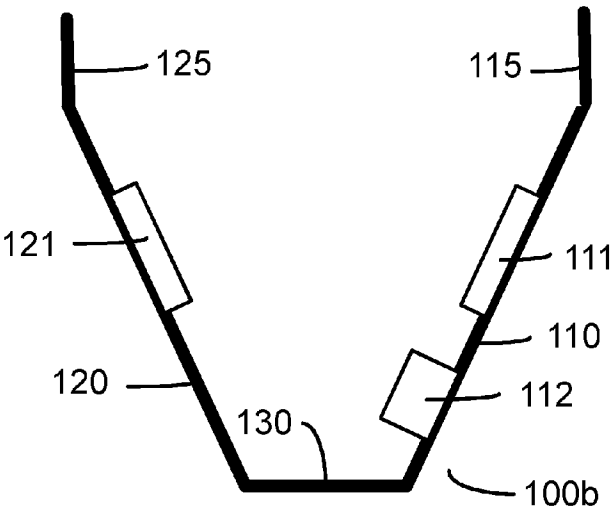
FIG. 1*d* is a schematic diagram showing a top view of the embodiment of FIG. 1*c;*

FIG. 1*c* is an assembly view of another embodiment of the invention, and FIG. 1*d* is a top view of the embodiment of FIG. 1*c*. The embodiment of FIGS. 1*e* and 1*d* is generally similar to that of FIGS. 1*a* and 1*b*, and the description is not repeated on that regard. However, in the embodiment of FIGS. 1*c* and 1*d*, the first rigid printed circuit board 110 comprises additional bendable portions 115, 116 at an end portion of the first rigid printed circuit board 110 which is opposite to the end to which the main bendable portion 130 is connected, and the second rigid printed circuit board 120 comprises additional bendable portions 125, 126 at an end portion of the second rigid printed circuit board 120 which is opposite to the end to which the main bendable portion 130 is connected. Obviously, even though FIG. 1*c* shows a total of four additional bendable portions, any number of additional bendable portions is possible. Furthermore, the locations of the additional bendable portions shown in FIG. 1*c* are merely examples, as any suitable locations/positions are possible. FIG. 1*d*, the additional bendable portions 115, 125 are bendable inwards with respect to the convex like shape. However, any of the additional bendable portions 115, 146, 125, 126 are bendable inwards and/or outwards, as needed. Furthermore, even though in the example of FIG. 1*e* bends of the additional bendable portions 115, 116, 125, 126 are substantially vertical or horizontal, these bends may be arranged in any suitable position, as needed.

At least one of the at least two radiating antenna elements in at least one of the first rigid printed circuit board and the second rigid printed circuit board may be embedded in the additional bendable portion of the respective rigid printed circuit board. In the embodiment of FIGS. 1*c* and 1*d*, the radiating antenna element 114 is embedded in the additional bendable portion 115 of its respective rigid printed circuit board 110, and the radiating antenna element 124 is embedded in the additional bendable portion 125 of its respective rigid printed circuit board 120. In another embodiment, the radiating antenna element 113 may be embedded partly in the first rigid printed circuit board 110 and partly in the additional bendable portion 116, the radiating antenna element 114 may be embedded partly in the first rigid printed circuit board 110 and partly in the additional bendable portion 115, the radiating antenna element 123 may be embedded partly in the second rigid printed circuit board 120 and partly in the additional bendable portion 126, and/or the radiating antenna element 124 may be embedded partly in the second rigid printed circuit board 120 and partly in the additional bendable portion 125. Also, as in the case of FIG. 1*a* at least one of the radiating antenna elements 113, 114, 123, 124 may instead be positioned so that it is embedded partly in the first rigid printed circuit board 110 and/or in the second rigid printed circuit board 120, and partly in a main bendable portion 130.

The additional bendable portions 115, 125 allow a decrease in the overall width of the wireless communication apparatus 100*b*. Also, the bending radius can be increased without increasing the overall width of the wireless communication apparatus 100*b*. Furthermore, it allows the radiating antenna elements 114, 124 embedded in the additional bendable portions 115, 125 to be substantially parallel to each other when the wireless communication apparatus 100*b* is bent in the convex like shape.

FIG. 1*e* is a top view of yet another embodiment of the invention. The embodiment of FIG. 1*e* is generally similar to that of FIGS. 1*c* and 1*d*, and the description is not repeated on that regard. However, in the embodiment of FIG. 1*e*, a vehicle light element 140 is arranged between the additional bendable portions 115 and 125 in the convex like shape. The vehicle light element 140 may comprise e.g. an additional brake light light-emitting diode (LED) arrangement. LED emitters need to have power, controls, current drivers, and heat sink. These can be provided when LED drivers are assembled into a same printed circuit board with a modem's electrical parts. USD power may be provided for the LED lights and the modem controls may be used. This will allow less cabling. It is to be noted that the vehicle light element 140 may alternatively be arranged between the first rigid printed circuit board 110 and the second rigid printed circuit board 120 of FIG. 1*b*, i.e. at an open end of the wireless communication apparatus 100*a* without the additional bendable portions 115 and 125. LED emitters may be assembled on their own printed circuit board or on the same printed circuit board as the modem(s). This design aspect may be selected taking into account e.g. spare part logistics and cost structure etc. Furthermore, the wireless communication apparatus 100*a*/100*b* may contain one or more sensors like temperature, acceleration, humidity, rain sensor, sunlight sensor or salinity sensor.

Figure 2:
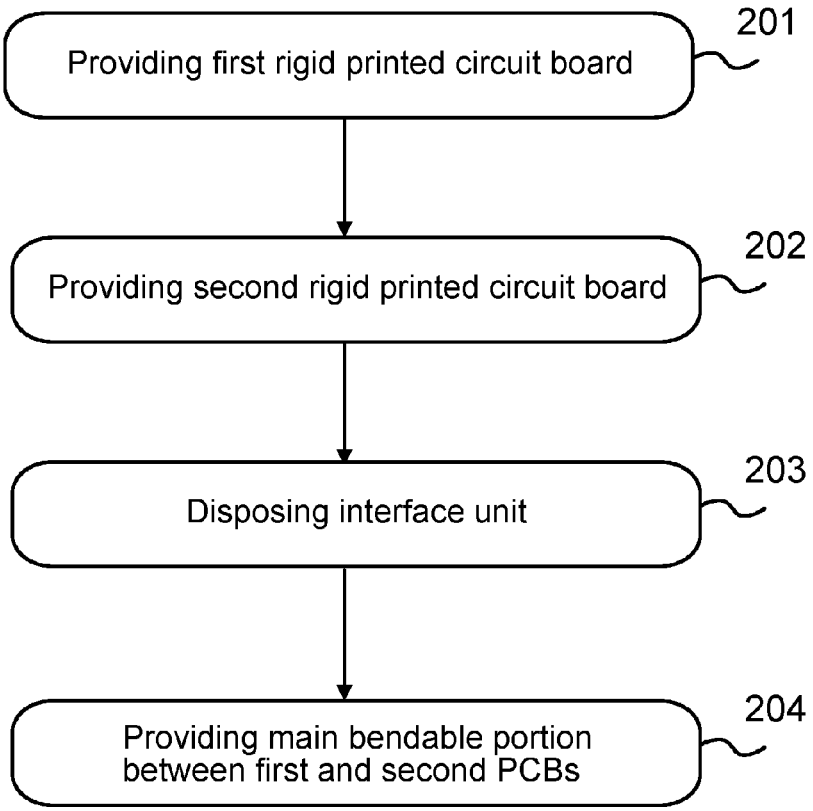
FIG. 2 is a flow diagram illustrating a method according to an embodiment of the present invention.

FIG. 2 is a flow illustrating a method of providing a wireless communication apparatus for a vehicle according to an embodiment of the present invention.

At step 201, a first rigid printed circuit board is provided, the first rigid printed circuit board having at least one modem unit disposed on it, and having at least one radiating antenna element embedded in it. At step 202, a second rigid printed circuit board is provided, the second rigid printed circuit board having at least one radiating antenna element embedded in it. At step 203, at least one interface unit is disposed on at least one of the first rigid printed circuit board and the second rigid printed circuit board. At step 204, a main bendable portion is provided, the main bendable portion bendably and electrically connecting the first rigid printed circuit board and the second rigid printed circuit board to each other. The first rigid printed circuit board and the second rigid printed circuit board are mountable on an outer surface of a vehicle in substantially vertical positions with respect to the outer surface, with the first rigid printed circuit board and the second rigid printed circuit board forming a convex like shape in a horizontal direction via bending of the main bendable portion.

Figure 3:
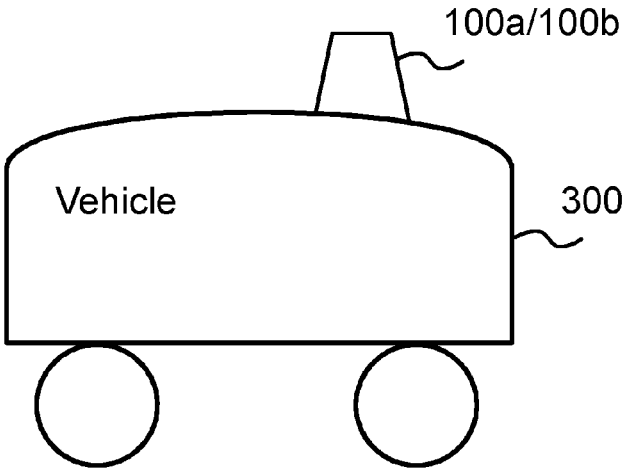
FIG. 3 is a schematic diagram that illustrates a vehicle comprising the wireless communication apparatus according to an embodiment of the present invention.

FIG. 3 illustrates a vehicle 300 (such as e.g. an automobile or the like) comprising the wireless communication apparatus 100 according to an embodiment of the present invention. The wireless communication apparatus 100 may have suitable industrial design, e.g. a shark fin shaped Outer cover improving its aerodynamic properties.

The exemplary embodiments can include, for example, any suitable wireless devices and the like, capable of performing the processes of the exemplary embodiments. The devices and subsystems of the exemplary embodiments can communicate with each other using any suitable protocol such as cellular protocol and/or local area protocol and/or short range protocol and can be implemented using one or more programmed computer systems or devices.

Embodiments of the present invention may be implemented in software, hardware, application logic or a combination of software, hardware and application logic.

All or a portion of the exemplary embodiments can be conveniently implemented using one or more general purpose processors, microprocessors, digital signal processors, micro-controllers, and the like, programmed according to the teachings of the exemplary embodiments of the present inventions, as will be appreciated by those skilled in the computer and/or software art(s). The exemplary embodiments can be implemented by the preparation of application-specific integrated circuits or by interconnecting an appropriate network of conventional component circuits, as will be appreciated by those skilled in the electrical art(s). Thus, the exemplary embodiments are not limited to any specific combination of hardware and/or software.

If desired, the different functions discussed herein may be performed in a different order and/or concurrently with each other.

While the present inventions have been described in connection with a number of exemplary embodiments, and implementations, the present inventions are not so limited, but rather cover various modifications, and equivalent arrangements, which fall within the purview of prospective claims.

We claim:

1. A wireless communication apparatus for a vehicle, comprising:

a first rigid printed circuit board;

a first modem unit disposed on the first rigid printed circuit board;

at least one radiating antenna element at least partly embedded in the first rigid printed circuit board;

a second rigid printed circuit board;

at least one radiating antenna element at least partly embedded in the second rigid printed circuit board;

at least one interface unit disposed on at least one of the first rigid printed circuit board or the second rigid printed circuit board; and a main bendable portion bendably and electrically connecting the first rigid printed circuit board and the second rigid printed circuit board, wherein the first rigid printed circuit board and the second rigid printed circuit board are configured to be mountable on an outer surface of a vehicle in non-horizontal positions with respect to a mounting area of the outer surface, with the first rigid printed circuit board and the second rigid printed circuit board forming a convex like shape in a horizontal direction via bending of the main bendable portion, and at least one of the first rigid printed circuit board or the second rigid printed circuit board comprise at least one additional bendable portion, which is bendable at least one of inwards and outwards with respect to the convex like shape.

2. The wireless communication apparatus according to claim 1, wherein the non-horizontal positions are substantially vertical positions.

3. The wireless communication apparatus according to claim 1, further comprising:

a second modem unit disposed on at least one of the first rigid printed circuit board or the second rigid printed circuit board.

4. The wireless communication apparatus according to claim 1, wherein the at least one radiating antenna element in the first rigid printed circuit board and at least one radiating antenna element in the second rigid printed circuit board are located substantially opposite to each other in the convex like shape.

5. The wireless communication apparatus according to claim 1, wherein the at least one additional bendable portion is located at an end portion of the at least one of the first rigid printed circuit board or the second printed circuit board opposite to an end to which the main bendable portion is connected.

6. The wireless communication apparatus according to claim 1, wherein at least one of the radiating antenna elements in at least one of the first rigid printed circuit board and the second rigid printed circuit board is at least partly embedded in one of the additional bendable portions of the respective rigid printed circuit board.

7. The wireless communication apparatus according to claim 1, wherein a bending radius of the convex like shape is utilized to optimize predetermined quality parameters of the wireless communication apparatus.

8. The wireless communication apparatus according to claim 7, wherein the predetermined quality parameters comprise at least one of efficiency, radiation patterns, or envelope correlation.

9. The wireless communication apparatus according to claim 1, wherein the convex like shape is one of a substantially V-like shape or a substantially U-like shape.

10. The wireless communication apparatus according to claim 1, comprising:

a plurality of radiating antenna elements embedded in the first rigid printed circuit board.

11. The wireless communication apparatus according to claim 1, comprising:

a plurality of radiating antenna elements embedded in the second rigid printed circuit board.

12. The wireless communication apparatus according to claim 1, wherein the at least one radiating antenna element comprises at least one of a cellular antenna element, a Wi-Fi antenna element or a Global Positioning System (GPS) antenna element.

13. The wireless communication apparatus according to claim 1, further comprising:

a temperature sensor configured to detect a temperature outside of the vehicle.

14. The wireless communication apparatus according to claim 1, further comprising:

a light sensor configured to detect an amount of light outside of the vehicle.

15. The wireless communication apparatus according to claim 1, further comprising:

a rain sensor configured to detect rain.

16. A wireless communication apparatus for a vehicle, comprising:

a first rigid printed circuit board;

a first modem unit disposed on the first rigid printed circuit board;

at least one radiating antenna element at least partly embedded in the first rigid printed circuit board;

a second rigid printed circuit board;

at least one radiating antenna element at least partly embedded in the second rigid printed circuit board;

at least one interface unit disposed on at least one of the first rigid printed circuit board or the second rigid printed circuit board; and a main bendable portion bendably and electrically connecting the first rigid printed circuit board and the second rigid printed circuit board, wherein the first rigid printed circuit board and the second rigid printed circuit board are configured to be mountable on an outer surface of a vehicle in non-horizontal positions with respect to a mounting area of the outer surface, with the first rigid printed circuit board and the second rigid printed circuit board forming a convex like shape in a horizontal direction via bending of the main bendable portion, and a vehicle light element is arranged between the first rigid printed circuit board and the second rigid printed circuit board at an open end of the convex like shape.

17. The wireless communication apparatus according to claim 16, wherein the at least one radiating antenna element comprises at least one of a cellular antenna element, a Wi-Fi antenna element or a Global Positioning System (GPS) antenna element.

18. The wireless communication apparatus according to claim 16, wherein at least one of the first rigid printed circuit board or the second rigid printed circuit board comprise at least one additional bendable portion, which is bendable at least one of inwards and outwards with respect to the convex like shape.

19. The wireless communication apparatus for a vehicle, comprising:

a first rigid printed circuit board;

a first modem unit disposed on the first rigid printed circuit board;

at least one radiating antenna element at least partly embedded in the first rigid printed circuit board;

a second rigid printed circuit board;

a second modem unit disposed on the second rigid printed circuit board;

at least one radiating antenna element at least partly embedded in the second rigid printed circuit board;

at least one interface unit disposed on at least one of the first rigid printed circuit board or the second rigid printed circuit board; and a main bendable portion bendably and electrically connecting the first rigid printed circuit board and the second rigid printed circuit board, wherein the first rigid printed circuit board and the second rigid printed circuit board are configured to be mountable on an outer surface of a vehicle in non-horizontal positions with respect to a mounting area of the outer surface, with the first rigid printed circuit board and the second rigid printed circuit board forming a convex like shape in a horizontal direction via bending of the main bendable portion, and the first modem unit and the second modem unit share at least two of the at least one radiating antenna elements for at least one of MIMO (multiple-input and multiple-output) and diversity operation.

20. The wireless communication apparatus according to claim 19, wherein the at least one radiating antenna element comprises at least one of a cellular antenna element, a Wi-Fi antenna element or a Global Positioning System (GPS) antenna element.

* * * * *